United States Patent [19]

Miller et al.

[11] 4,393,526

[45] Jul. 19, 1983

[54] POOL CLEANING APPARATUS

[76] Inventors: Paul B. Miller, 6513 Temba Dr.; Tony C. R. Miller, 6484 DuSault Dr., both of San Jose, Calif. 95119

[21] Appl. No.: 323,928

[22] Filed: Nov. 23, 1981

[51] Int. Cl.[3] ..... B08B 9/08; E04H 3/16

[52] U.S. Cl. ..... 4/490; 4/492; 134/167 C

[58] Field of Search ..... 4/488, 490–492, 4/496, 507; 134/167 C, 167 R, 168 C, 168 R; 137/455

[56] References Cited

U.S. PATENT DOCUMENTS

| | | | |
|---|---|---|---|
| 1,787,947 | 1/1931 | Lehnert | 137/455 |
| 3,261,371 | 7/1966 | Vernon | 4/490 X |
| 3,521,304 | 7/1970 | Ghiz | 4/490 |
| 4,030,148 | 6/1977 | Rosenberg | 4/490 |
| 4,114,206 | 9/1978 | Franc | 4/490 |
| 4,289,155 | 9/1981 | Sable | 4/490 X |

*Primary Examiner*—Stephen Marcus
*Assistant Examiner*—Kenneth S. Putnam
*Attorney, Agent, or Firm*—Paul L. Hickman

[57] ABSTRACT

A pool cleaning apparatus characterized by a long, hollow main body coupled to a pressurized swimming pool inlet and supporting a pair of cleaning hoses, a pressure relief valve, and an adjustable nozzle for producing a surface current. A primary cleaning hose sweeps the side and bottom surfaces of the pool, and a secondary cleaning hose follows up after the primary cleaning hose. The adjustable nozzle is used to direct a jet of water towards the surface of the water contained by the pool to create surface currents which urge floating debris towards the swimming pool's skimmers. The pressure relief valve controls the strength and vigor of the cleaning action of the apparatus.

11 Claims, 9 Drawing Figures

POOL CLEANING APPARATUS

BACKGROUND OF THE INVENTION

1. Field of the Invention

This invention relates generally to swimming pool equipment and more particularly to apparatus for cleaning swimming pools.

2. Description of the Prior Art

A swimming pool should be kept clean both for aesthetic and health reasons. Dirt, gravel, and other foreign objects can collect on the bottom of the pool, and calcium deposits can form on the sidewalls and bottom of the pool. Floating debris can remain on the water surface for extended periods of time unless periodically removed. Colloidal particles may remain suspended in the pools's water indefinitely.

The prior art discloses a number of devices which assist in keeping a swimming pool clean. Many of these devices are powered by pressurized water, either from a garden hose or from one of the pressurized water inlets of the swimming pool.

A typical pool cleaning apparatus is described in U.S. Pat. No. 3,577,571 of Bellinson and includes a plurality of long, flexible hoses each attached at one end to a pressurized water inlet of a swimming pool, and provided at their other end with a nozzle to produce a jet of water. As the hoses snake around in the bottom of the pool they sweep and blow any contaminents which may have settled to the bottom towards the drain in the deep end of the pool.

As noted in U.S. Pat. Nos. 3,820,172 of Kane, 4,087,286 of Sexton, and 2,975,791 of Pansini, bushings may be attached along the length of the hose to prevent premature wear. If the bushings are suitably configured and if they are constructed from the right kind of material they can also serve as cleaning bushings to remove calcium and other deposits from the walls and bottom of the swimming pool.

Single cleaning hoses have the disadvantage that they can miss great swaths along the bottom of the pool. For example, if the hoses are long, portions of the pool's bottom and sidewall surfaces near the inlet will probably not be cleaned. Alternatively, if the hoses are short the central areas of the pool's bottom probably can not be reached.

A problem not addressed by the prior art is how to urge floating debris and particles in colloidal suspension towards the skimmers. The only known reference which describes a mechanism for agitating the pool's water is that of Bellinson (cited above). In FIG. 5 of his patent, Bellinson teaches a whirlpool attachment for a pressurized swimming pool inlet that mixes air and water to produce a therapeutic burbling of the water near the inlet. Unfortunately, Bellinson's whirlpool attachment does not aid in directing floating debris towards the pool's skimmers and, in fact, may actually interfere with the operation of the skimmers.

Yet another problem not addressed by the prior art is how to control the whip-like action of the cleaning hoses. A valve could be place between the hose units and the pressurized inlets, but this could result in an undesirable pressure difference between the various inlets to the pool.

SUMMARY OF THE INVENTION

An object of this invention is to provide an efficient and inexpensive cleaning apparatus for a swimming pool.

A more specific object of this invention is to provide a pool cleaning apparatus which can effectively clean virtually every exposed surface of the swimming pool.

Another object of this invention is to provide such an apparatus which further helps to direct floating debris to the swimming pool's skimmers.

A still further object of this invention is to provide a hose type pool cleaning apparatus that can be adjusted without upsetting the pressure balance of the swimming pool's inlets.

Briefly, the invention includes a hollow main body portion, a first tubular member attaching the main body portion to a pressurized inlet of the swimming pool, a pressure relief valve attached to the main body portion, a pair of hoses coupled to the main body portion, and a nozzle adjustably mounted to the main body portion to create a surface current which sweeps floating debris towards the pool's skimmer. The hoses, one of which is long and one of which is short, cooperate to sweep most of the sidewall and bottom surfaces of the swimming pool. The pressure relief valve can vent a portion of the pressurized water directly into the pool, thus diverting it from the hoses and the nozzle.

An advantage of this invention is the association of a pair of hoses which cooperate to more effectively clean the sidewall and bottom surfaces of the swimming pool. The longer hose serves as a primary cleaning hose, and the shorter hose serves as a secondary cleaning hose which follows up after the primary hose.

Another advantage of this invention is that the pressure relief valve allows the action of the hoses and the water jet issuing from the nozzle to be adjusted without throwing off the pressure balance between the swimming pool's inlets, as a simple contriction valve would.

Yet another advantage of this invention is that the pool cleaning apparatus includes a directable nozzle that produces a jet of water which urges floating debris towards the swimming pool's skimmers.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 1:
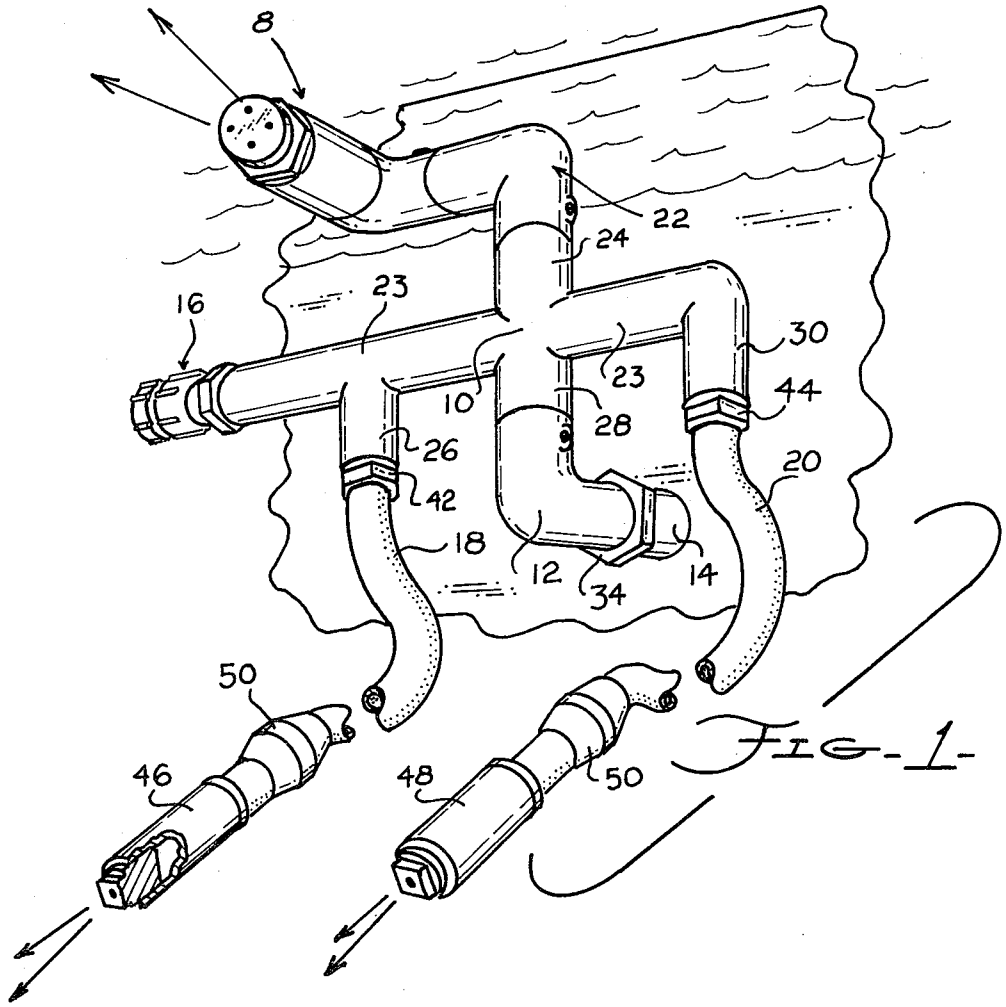
FIG. 1 is a perspective view of a swimming pool cleaning apparatus in accordance with the present invention.

Referring to the perspective view of FIG. 1, a pool cleaning apparatus 8 in accordance with the present invention includes a hollow main body portion 10, an L shaped pipe 12 coupling the main body portion to a pressurized outlet 14, a pressure relief valve 16 coupled to the main body portion, a pair of cleaning hoses 18 and 20 having their upper ends coupled to portion 10, and a directable nozzle assembly 22 also coupled to the main body portion. The assembly is preferably made from an inert plastic material that is not adversely affected by water or by the chemicals typically found in swimming pool water.

Main body portion 10 of this preferred embodiment includes an elongated tubular structure 23 having an upwardly extending, tubular projection 24 and three downwardly extending, tubular projections 26, 28, and 30. However, the shape of the main body portion is not critical as long as it has the structural strength to support the various other members, and has an internal void or chamber for distributing the pressurized water supplied by the inlet to the various other members. For example, one embodiment of this invention (not shown) has a half-round, tubular main body portion with recessed attachment points for the other members.

Figure 2:
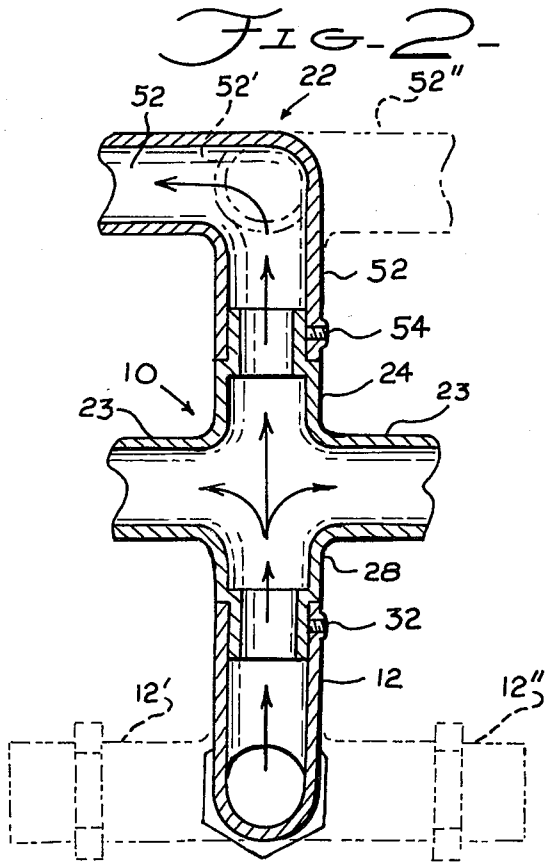
FIG. 2 is a cross-sectional view of part of the main body portion and part of the adjustable member coupling the nozzle to the main body portion.

Referring now to the cross-sectional view of FIG. 2, L shaped pipe 12 engages the constricted end of projection 28 and is affixed to it by a set screw 32. By loosening the set screw L shaped pipe 12 can be rotated a full 360°, as indicated at 12′ and 12″. The end of the L shaped pipe can be press fit over the end of the swimming pool inlet 14 or, if the inlet is provided with pipe threads, can be attached to the inlet with a threaded collar. This swivel type attachment of the L shaped pipe to the main body portion allows the apparatus to be attached to any inlet irregardless of its angle of protrusion from the side of the pool.

Figure 3:
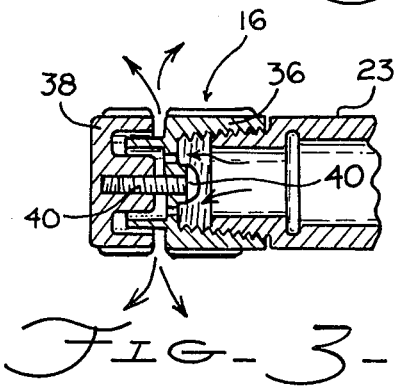
FIG. 3 is a cross-sectional view of the pressure relief valve.

Pressure relief valve 16 (best seen in the cross sectional view of FIG. 3) includes a valve seat portion 36 attached to the open end of portion 23 and a valve closure portion 38 rotatably coupled to portion 36 by a threaded shaft 40. The valve closure portion 38 is rotatable between a fully closed postion where it is in abutment with the valve seat portion, and a fully open position where the impediment to water flowing through the valve is minimal. Between the fully open and fully closed positions the water flow through the valve is restricted by varying amounts.

Referring again to FIG. 1, cleaning hoses 18 and 20 are elongated, flexible tubes attached at their upper ends to projections 26 and 30, respectively, by couplings 42 and 44, respectively. The lower ends of the hoses are attached to nylon nozzles 46 and 48, respectively. As water is ejected from the nozzles the hoses are caused to snake or whip around the bottom and across the sidewalls of the pool. Nylon bushings 50 are attached all along the length of the hoses to prevent wear and to scrub away calcium deposits which tend to build up on the sidewalls and bottom of the pool.

One of the hoses is the primary hose and is typically ten to fifteen feet long. The other one of the hoses is a secondary or follow-up hose and is typically only half as long. As will be discussed subsequently, the two hoses co-act to thoroughly scrub all portions of the sidewalls and bottom of the pool within their reach.

Returning to FIG. 2, nozzle assembly 22 is shown to include a first L shaped pipe 52 attached to the constricted end of projection 24 by a set screw 54. Pipe 52 can rotate a full 360° as indicated at 52′ and 52″.

Figure 4:
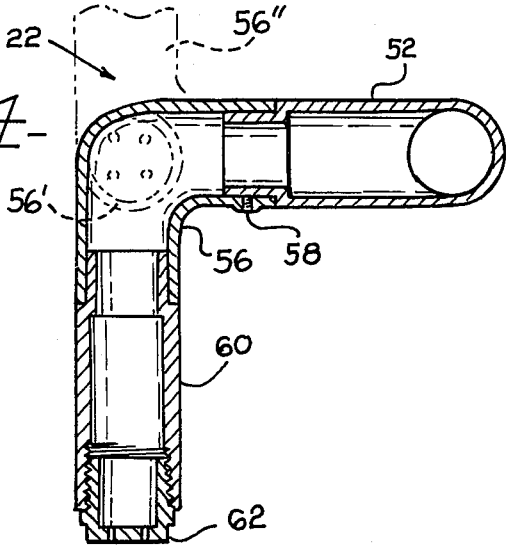
FIG. 4 is a cross-sectional view of the remainder of the adjustable member shown in FIG. 2.

As illustrated in FIG. 4, the nozzle assembly 22 also includes a second L shaped pipe 56 attached to the constricted end of pipe 52 by a set screw 58. Pipe 56 can also rotate 360° around its attachment to pipe 52 as shown at 56′ and 56″.

A nozzle 62 is coupled to the end of pipe 56 by a short connector 60. The nozzle is normally located beneath the water's surface and, as will be discussed in greater detail later, is pointed towards the swimming pool's skimmers. By adjusting pipes 52 and 56 the nozzle can be pointed in almost any direction.

Figure 5:
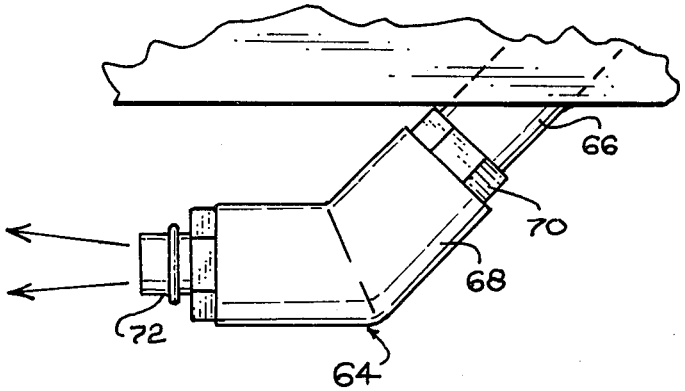
FIG. 5 is a plan view of an auxilliary nozzle used to direct floating debris towards the swimming pool's skimmers.

FIG. 5 illustrates an auxilliary nozzle 64 attached to a pressurized inlet 66 of the swimming pool. The auxilliary nozzle includes an angled, tubular portion 68, a threaded collar 70 attaching portion 68 to the inlet, and a nozzle 72 attached to the end of the angled tubular portion.

Figure 6:
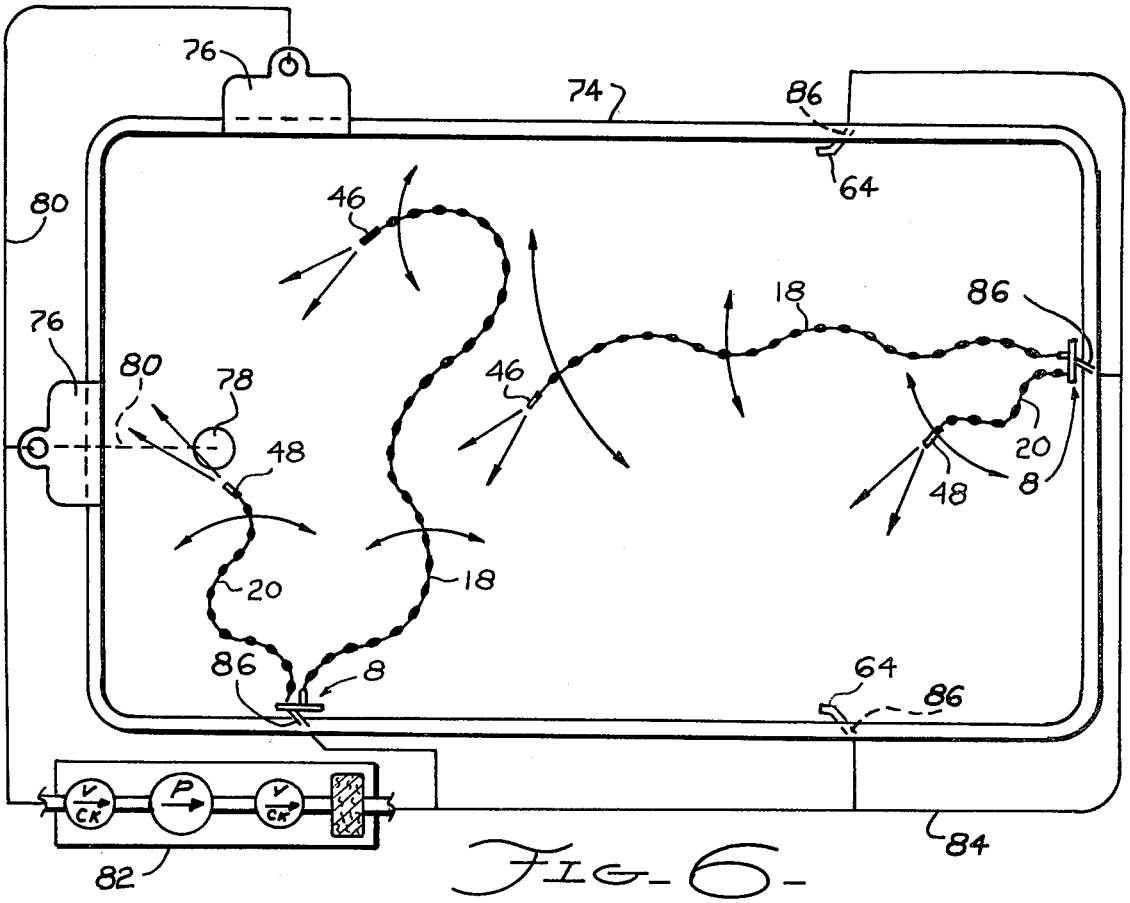
FIG. 6 is a plan view of a swimming pool illustrating the action of the cleaning hoses of the present device.

In FIG. 6 the operation of the cleaning hoses of the invention is illustrated. A swimming pool 74 is provided with skimmers 76, a drain 78 (in the deep end of the pool), outlet lines 80 coupling the skimmers and drain to a pump-and-filter assembly 82, and inlet lines 84 coupling the output of the pump and filter assembly to pool inlets located at 86.

As noted in the figure, when water is forced out of the orifices of nozzles 46 and 48 the cleaning hoses 18 and 20 are caused to snake back and forth across the bottom and sidewalls of the pool. The longer or primary hoses, here labeled 18, sweep across a wide swath, blowing and pushing debris towards the drain in the deep end. The long hoses 18, however, are not very effective in cleaning near the inlets to which they are attached. The short hoses 20 clean near the inlets to which they are attached and blow and push debris towards the primary or long hoses 18 which, in turn, push and blow the debris towards the drain. Thus, the short and long hoses cooperate to clean both near their attachment point to the inlet and to move debris all the way to the drain. The multiple units 8 also cooperate, i.e. the apparatus on the right moves debris within the reach of the apparatus on the left, which in turn moves the debris to the drain.

Figure 7:
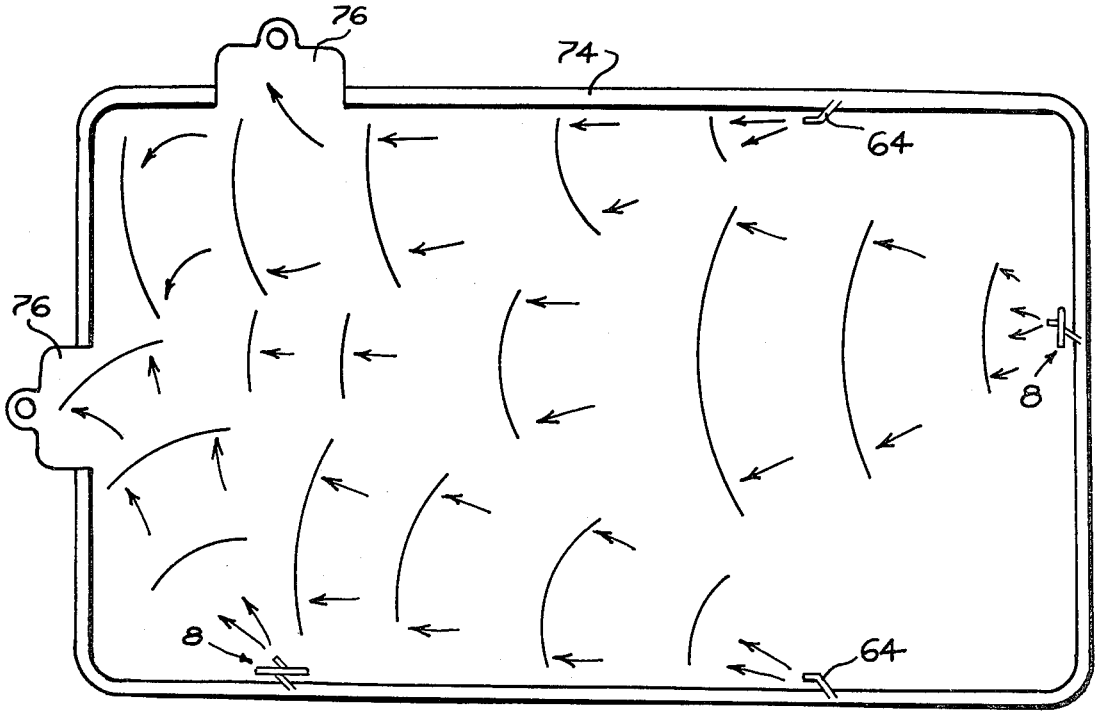
FIG. 7 is a plan view of a swimming pool illustrating the surface currents produced by the present device.

In FIG. 7 the apparatus 8 of this invention and the auxilliary nozzles 64 are shown to create surface currents which cause floating debris to migrate towards skimmers 76. It becomes clear by studying this figure that the nozzle assembly 22 of the apparatus must be adjustable to optimize the effectiveness of the surface current. The auxilliary nozzles are not adjustable and thus direct the current down the sidewalls of the pool either towards skimmer 76 or towards the nozzle assembly of apparatus 8 which then re-directs the current towards a skimmer. The nozzle assemblies 22 should be pointed towards the skimmer and at least slightly towards the water's surface to promote maximum surface current. While this assembly is most effective in moving floating matter towards the skimmers, particles in colloidal suspension are also urged towards the skimmers.

Figure 8:
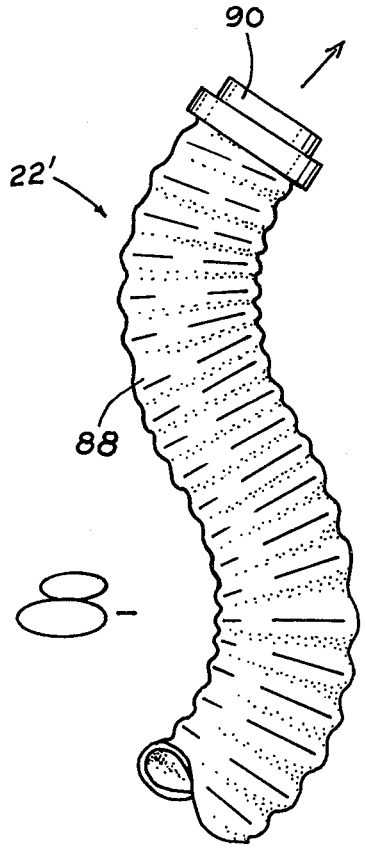
FIG. 8 is a partial elevational view of an alternate embodiment of the adjustable nozzle member.
Figure 9:
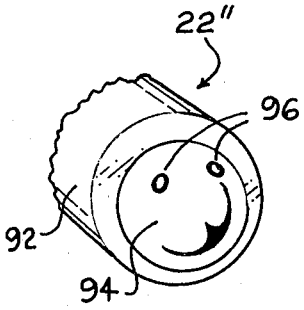
FIG. 9 is a partial perspective view of another alternate embodiment of the adjustable nozzle member.

In FIG. 8 an alternate embodiment 22′ for the nozzle assembly includes a flexible conduit 88 and a nozzle 90. The conduit is attached to the main body portion. Another alternate embodiment 22" for the nozzle assembly is shown in FIG. 9 and includes a socket 92 attached to the main body portion, a ball 94 carried by the socket, and a pair of orifices 96 (preferably separated by about 45°) provided in the ball 94. Either of these alternate constructions for the nozzle assembly will direct a flow of water towards the pool's skimmer as discussed earlier.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A pool cleaning apparatus for attachment to a pressurized inlet of a swimming pool, the apparatus comprising:

(a) a main body portion provided with a chamber;

(b) first means coupling said main body portion to said inlet such that pressurized water may flow from said inlet into said chamber;

(c) a pressure relief valve coupled to said main body portion for selectively venting said pressurized water within said chamber;

(d) an elongated, flexible primary cleaning hose having a first end coupled to said main body portion and opening on said chamber, whereby pressurized water from said chamber may flow out a second end of said hose;

(e) a nozzle submerged below the surface of the water contained by said swimming pool to direct a flow of water towards said water surface; and (f) second means coupling said nozzle to said main body such that pressurized water from said chamber may flow out of said nozzle, wherein said second means is adjustable to permit the angle and direction of the flow of water from said nozzle to be varied.

2. A pool cleaning apparatus as recited in claim 1 wherein said second means includes a first swivel member which allows said nozzle to swivel at least partially around a first axis.

3. A pool cleaning apparatus as recited in claim 2 wherein said second means further includes a second swivel member which allows said nozzle to swivel at least partially around a second axis that is normal to said first axis.

4. A pool cleaning apparatus as recited in claim 1 wherein said second means includes a flexible conduit.

5. A pool cleaning apparatus as recited in claim 1 wherein said second means includes a socket coupled to said main body portion and a ball which moves within said socket, said nozzle being carried by said ball.

6. A pool cleaning apparatus as recited in claim 1 wherein said pressure relief valve includes a valve seating means coupled to said main body portion, and a valve closure means rotatably coupled to said valve seating means.

7. A pool cleaning apparatus as recite in claim 1 wherein said primary hose is provided with a nozzle at said second end, and a plurality of bushings along its length.

8. A pool cleaning apparatus as recited in claim 1 further comprising an elongated, flexible secondary cleaning hose having a first end coupled to said main body portion and opening on said chamber, whereby pressurized water from said chamber may flow out a second end of said hose, said secondary hose being substantially shorter than said primary hose.

9. A pool cleaning apparatus as recited in claim 1 wherein both said primary hose and said secondary hose are provided with a nozzle at their respective second ends, and wherein both said primary hose and said secondary hose are provided with a plurality of bushings along their respective lengths.

10. A pool cleaning apparatus for attachment to a pressurized inlet of a swimming pool, the apparatus comprising:

(a) a main body portion provided with a chamber;

(b) first means coupling said main body portion to said inlet such that pressurized water may flow from said inlet into said chamber;

(c) an elongated, flexible primary cleaning hose having a first end coupled to said main body portion and opening on said chamber, whereby pressurized water from said chamber may flow out a second end of said hose;

(d) an adjustable coupling attached to said main body portion and communicating with said chamber; and (e) nozzle means attached to said adjustable coupling such that water may flow from said chamber, through said adjustable coupling, and out said nozzle means, whereby said adjustable coupling permits the direction of the flow of water from said nozzle to be varied.

11. A pool cleaning apparatus as recited in claim 10 further comprising a pressure relief valve coupled to said main body portion for selectively venting said pressurized water within said chamber.

* * * * *